United States Patent [19]

Hullihen

[11] Patent Number: 4,523,687

[45] Date of Patent: Jun. 18, 1985

[54] NON-REFILLABLE POURER

[76] Inventor: John Hullihen, Rte. 4, Box 959, Hillsboro, Oreg. 97123

[21] Appl. No.: 665,762

[22] Filed: Oct. 29, 1984

[51] Int. Cl.[3] ..... B65D 49/06

[52] U.S. Cl. ..... 215/25; 215/20

[58] Field of Search ..... 215/25, 20, 21

[56] References Cited

U.S. PATENT DOCUMENTS

| | | | |
|---|---|---|---|
| 2,103,065 | 12/1937 | Conkling | 215/25 |
| 2,335,634 | 11/1943 | Benschoter | 215/21 |
| 2,954,889 | 10/1960 | Kozlik | 215/21 |
| 2,991,897 | 7/1961 | Burnett | 215/21 |
| 3,063,589 | 11/1962 | Musel | 215/21 |
| 3,814,273 | 6/1974 | Bereziat | 215/20 |
| 4,217,988 | 8/1980 | Mills et al. | 215/21 |

*Primary Examiner*—Donald F. Norton
*Attorney, Agent, or Firm*—Chernoff, Vilhauer, McClung, Birdwell & Stenzel

[57] ABSTRACT

A non-refillable pour spout, for use in the neck of a bottle to prevent introduction of liquid into the bottle but permit liquid already within the bottle to be poured from the bottle in any direction, includes a pair of check valves in a liquid pouring duct and a third check valve in a separate air entry conduit which extends through the pour spout alongside the liquid pouring duct. The pour spout fits within the neck of a bottle, where it is retained sealingly by a plurality of flexible collars extending about the circumference of the pourer spout. A horizontal flange extends radially about the upper end of the liquid discharge tube, a small distance above the upper end of the air entry vent conduit, to protect the air entry vent conduit against introduction of liquid and to permit liquid to be poured in any direction without spilling into the open end of the air entry conduit. A valve closure body in one of the check valves in the liquid pouring duct is less dense than the liquid for which the valve is intended to be used.

16 Claims, 6 Drawing Figures

NON-REFILLABLE POURER

BACKGROUND OF THE INVENTION

The present invention relates to pouring spouts for glass or plastic bottles, and more particularly to a pouring spout of the type adapted for permanent fitment within the neck of bottle and which includes a combination of check valves and an air inlet conduit permitting liquid to be poured from within the bottle, but preventing liquid from being returned to the interior of the bottle.

A serious and continuing problem, particularly in the liquor trade, is the adulteration or replacement of expensive or rare liquor by a substitute of lower quality. Sales of the adulterated or substituted beverage can harm the reputation and cut into the total sales volume of the producer of the more expensive beverage and deprive the consumer of the quality of product for which he pays. While non-refillable pour spout devices have been designed previously to prevent this practice, the previously known non-refillable pour spouts have been less than satisfactory for various reasons.

For example, a non-refillable bottle cap and spout disclosed in Burnett U.S. Pat. No. 2,991,897 requires a specially-designed bottle neck for its attachment, and requires a bottle to be tipped always in a certain direction for pouring liquid from the bottle.

Musel U.S. Pat. No. 3,063,589 discloses a non-refillable pouring spout including a check valve which includes ample room for insertion of a tool to prevent the valve from closing, allowing the bottle to be refilled through the valve. Additionally, the location of the air inlet tube intended to permit flow of air into the interior of the bottle requires the bottle to be tipped in a particular direction in order to obtain the best pouring performance.

Kozlik U.S. Pat. No. 2,954,889 discloses another non-refillable bottle cap which requires that the bottle be tipped in a certain direction for pouring. Kozlik also discloses the use of a check valve in the air inlet tube of his bottle cap, but because of the construction of the Kozlik bottle cap it requires a specially designed bottle neck. Adoption of this bottle cap would therefore be undesirably expensive for liquor manufacturers.

Mills, et al., U.S. Pat. No. 4,217,988, discloses a non-refillable pouring spout which fits within the neck of a bottle and includes a check valve, but it would seem to be possible to refill a bottle through such a device by holding the bottle tipped to a horizontal attitude, partially submerged, or with the annular pouring opening partly covered. Benschoter U.S. Pat. No. 2,335,634 discloses a pouring valve which attempts to defeat refilling of a bottle by inclusion of a check valve and a vent tube directed toward the check valve.

One problem with some previously available non-refillable pour spouts is that they tend to pour unevenly as air flows into the bottle in which such spouts are used against the flow of liquid. In other previously known non-refillable spouts, a certain amount of liquid may drip or pour from the vent tube initially during pouring unless pouring is done in a particular direction.

What is needed, then, is an improved non-refillable pour spout which provides protection against refilling a bottle through either the liquid pouring duct or the air inlet tube. Such a spout should protect against refilling the bottle with the bottle in any attitude and also if the bottle is submerged. It is desirable that such a pour spout permit liquid to be poured from a bottle in which it is installed in any direction, with an even flow, and without liquid from within the bottle flowing outward through an air vent tube.

SUMMARY OF THE INVENTION

The present invention overcomes some of the shortcomings of previously known non-refillable pour spouts by providing an improved non-refillable pour spout, including a pair of check valves in line with one another in a liquid pouring duct and a separate air vent inlet tube also provided with a check valve. Liquid is prevented by these check valves from entering a bottle through the pour spout of the present invention, either through the normal liquid pouring duct or through the air inlet conduit. A radially-extending flange is provided at the top of the liquid pouring duct, above the upper end of the air inlet conduit, to further protect against spillage of liquid or intentional introduction of liquid into the bottle through the air inlet conduit and to enhance pouring in any direction.

In one of the two check valves in the liquid pouring duct, and in the check valve in the air inlet conduit, the movable valve closure body is of a low enough density to float in the liquid for which the pour spout is intended to be used. The valve closure body of the other check valve in the liquid pouring duct is of a greater density than the liquid to be contained, so that it will remain closed despite the pouring duct being filled while the bottle is upright, and despite attempts to introduce liquid through the air inlet conduit.

It is therefore a principal object of the present invention to provide an improved non-refillable pourer spout which provides an improved resistance to refilling and permits liquid to be poured in any direction from the bottle with which it is used.

It is another important object of the present invention to provide a pour spout for a bottle which resists refilling regardless of immersion of the bottle with which it is used and regardless of whether or not the bottle is upright, tilted or inverted during attempts to refill the bottle through the pour spout.

It is an important feature of the present invention that it provides a pour spout including a pair of check valves located one above the other within a liquid pouring duct to prevent introduction of liquid into the bottle with which the pour spout of the present invention is used, as well as a check valve included in the air inlet conduit to prevent introduction of liquid into the bottle through the air inlet conduit.

It is another important feature of the present invention that of the two check valves in the liquid pouring duct, the upper check valve includes a valve closure body which is less dense than the liquid for which the pour spout is intended to be used, while the lower one includes a valve closure body which is denser than the liquid for which the pour spout is intended to be used.

A further feature of the present invention is that it includes a flange extending radially about the outer end of the liquid pouring duct and above the open outer end of the air inlet vent conduit as a canopy to prevent liquid from being spilled or intentionally introduced into the air inlet conduit and to permit pouring of liquid through the pour spout of the present invention in any direction.

It is an important advantage of the present invention that it provides a non-refillable pour spout which permits pouring in any direction from a bottle in which the pour spout of the invention is used.

It is another important advantage of the present invention that it provides greater resistance to refilling the bottle with which it is used than was the case with previously available non-refillable pour spouts.

It is another advantage of the pour spout of the present invention that it does not require the neck of a bottle with which it is used to be of a special form.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 2:
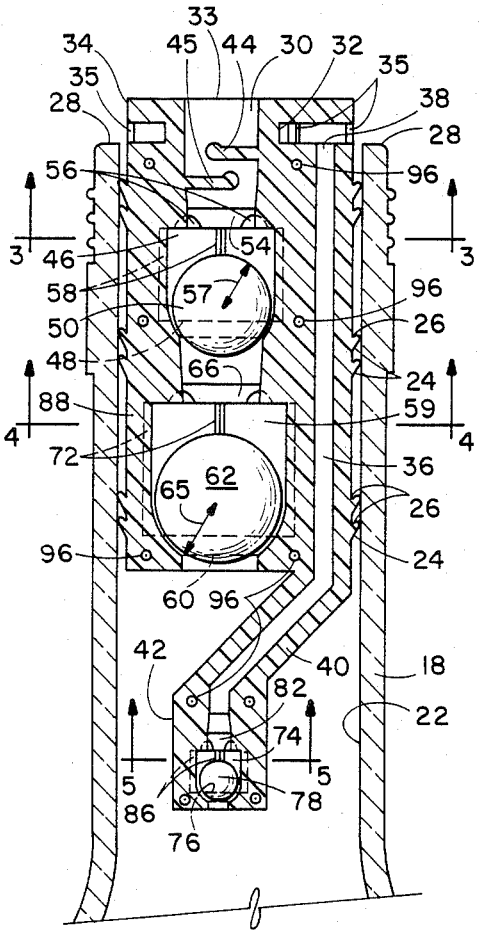
FIG. 2 is a sectional view of the pour spout shown in FIG. 1, showing the pour spout installed in the neck of a bottle.
Figure 1:
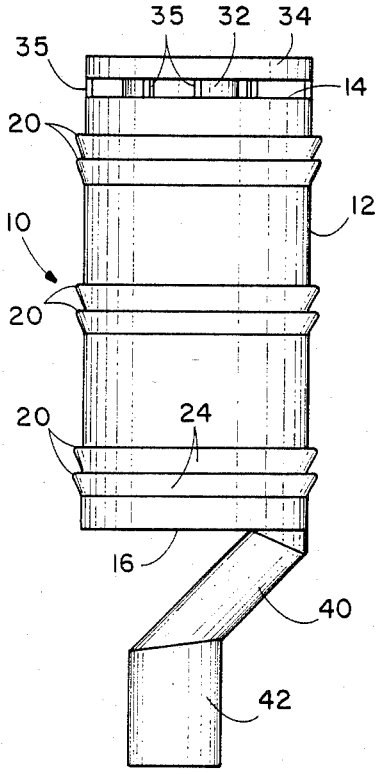
FIG. 1 is a side elevational view of a non-refillable pour spout embodying the present invention.

Referring now to the drawings, a non-refillable pour spout 10 shown in FIG. 1 has a generally cylindrical spout body 12 having a top end 14 and a bottom end 16. As shown in FIG. 2, the spout body 12 is of a size which will fit within the neck 18 of a bottle with a small amount of radial clearance around the cylindrical portion of the spout body 12. A set of tapered collars 20 extend radially outwardly, surrounding the spout body 12. The collars 20 are elastically deformable and compressible to fit tightly against the inner surface 22 of the neck 18 and thus sealingly secure the spout 10 within the neck 18. Preferably, each of the collars 20 includes a frusto-conical lower surface 24, and an upper surface 26 which may extend radially or be sloped slightly downwardly from the outermost edge of the collar 20 toward the cylindrical surface of the spout body 12. The collars 20 thus permit the spout 10 to be inserted into the neck 18 of a bottle more easily than it can be withdrawn therefrom.

As may be seen more clearly in FIG. 2, the spout 10 is preferably mounted within the neck 18 so that the top 14 is at the height of the top edge 28 of the neck 18. The spout 10 may therefore be used in a bottle having a conventional neck 18 for receiving a screw-on cap. The neck 18 of the bottle may also be manufactured to include parallel circumferential grooves (not shown) in the inner surface 22 of the neck 18, located appropriately to receive the collars 20 when the spout 10 is located within the neck 18 at the proper location, and thereby further resist withdrawal of the spout 10 from within the neck 18.

The spout 10 includes a liquid pouring duct 30 extending through the spout body 12 between the top end 14 and bottom end 16. A discharge tube 32, which also forms part of the liquid pouring duct 30, extends upwardly a short distance above the top 14. Extending radially outward around the outer or upper end 33 of the discharge tube 32 is a circular flange 34 which has a diameter similar to that of the spout body 12 and is aligned with the spout body 12. Several columns 35 are located at spaced intervals around the flange 34, extending between the flange 34 and the top 14 of the spout body 12.

The liquid pouring duct 30 is located eccentrically within the spout body 12. Extending through the spout body 12 from the top 14 to the bottom 16 alongside the liquid pouring duct 30 is an air inlet conduit 36 having an open upper end 38 located beneath the flange 34 which acts as a canopy to protect the upper end 38.

An air inlet tube 40, including a part of the air inlet conduit 36, extends slopingly downward from the bottom end 16 of the spout body 12, and a lower portion 42 of the air inlet tube 40 extends further beneath the bottom end of the liquid pouring duct 30.

A pair of baffles 44 and 45 are located within the upper portion of the liquid pouring duct 30, extending overlappingly from opposite sides of the interior wall of the liquid pouring duct 30 and spaced apart from one another to permit liquid to flow substantially unobstructed through the duct 30. Each baffle extends beyond the center of the duct 30 and preferably includes an upturned edge in order to prevent insertion of wire or other tools into the pour spout 10 in a way which might defeat its ability to resist refilling the bottle in which it is used.

Within the liquid pouring duct 30, a first or upper ball check valve 46 includes an annular valve seat 48 having a spherical surface, and a movable upper valve closure body, preferably a spherical valve ball 50, which is free to move a small distance upwardly away from the upper valve seat 40 to permit the outward flow of liquid upwardly through the fluid exit conduit 30 when the spherical valve ball 50 is spaced apart from the upper valve seat 48.

Figure 3:
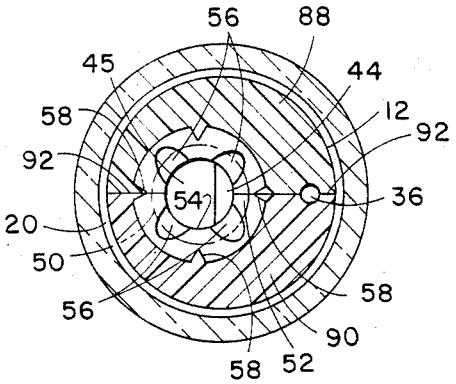
FIG. 3 is a sectional view of the pour spout shown in FIG. 1, taken along the line 3—3 of FIG. 2.

The valve ball 50 is restrained against movement farther than necessary to permit flow of liquid, by an upper valve body retainer 52, which includes a cylindrical bore 54 and has a plurality of inwardly and upwardly inclined notches 56 which may, for example, be in the shape of cylindrical surfaces intersecting the bore 54, as may be seen in FIG. 3. The notches 56 provide a path for flow of liquid around the valve ball 50 into the bore 54 when the valve ball 50 is displaced away from the valve seat 48 and held against the retainer 52 by the force of liquid flowing outward through the spout 10. The retainer 52 thus prevents the valve ball 50 from moving away from sealing contact against the seat 48 a distance greater than half the radius 57 of the valve ball 50, and preferably keeps the valve ball 50 within a distance of 1/16 inch from the seat 48, in a pour spout body 12 whose diameter is $\frac{3}{4}$ inch.

The valve ball 50 is preferably made of a plastic material which floats in the liquid with which the pour spout 10 is to be used, for example alcoholic liquor, so that the valve ball 50 will easily be displaced from the upper valve seat 48 as fluid is poured out of the bottle through the neck 18. However, should an attempt be made to introduce liquid through the nonrefillable pour spout 10 by inverting the bottle's neck 18 beneath the surface of the liquid attempted to be placed in the bottle, the valve ball 50 will float in such liquid and be seated sealingly against the upper valve seat 48 closing the liquid pouring duct 30.

As may be seen also in FIG. 3, several vertical guide posts 58 are provided within the upper check valve 46 to keep the valve ball 50 centrally located with respect to the valve seat 98, yet permit liquid to flow around the valve ball 50 within the space between the guide posts 58.

Also located in the liquid pouring duct 30 is a second, lower check valve 59 which has an annular lower valve seat 60. Like the upper valve seat 48, the lower valve seat 60 has a spherical surface, although it is larger than the upper valve seat 48 in a preferred embodiment of the invention. Located upwardly adjacent the lower valve seat 60 is a valve closure body such as a lower valve ball 62, which is spherical and of a size to sealingly fit against the lower valve seat 60 to close the liquid pouring duct 30 against passage of fluid through the non-refillable spout 10 into the interior of a bottle in whose neck 18 the spout 10 is fitted. Preferably, the lower valve ball 64 is made of glass or other chemically suitable material whose density is greater than that of the liquid to be contained in the bottle with which the pour spout 10 is used, so that if one attempts to pour liquid into the bottle through the non-refillable pour spout 10 with the bottle in an upwardly tilted or upright position, the lower valve 59 will remain closed, with the lower valve ball 62 seated against the lower valve seat 60.

Figure 4:
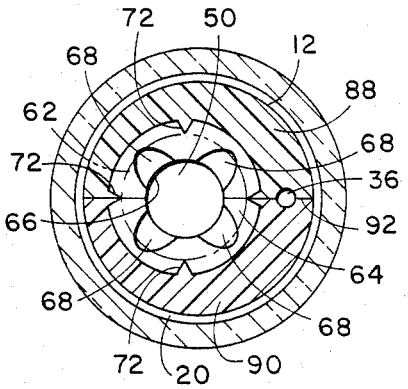
FIG. 4 is a sectional view of the pour spout shown in FIG. 1, taken along the line 4—4 of FIG. 2.

As in the upper check valve 46, a retainer 64, shown in FIGS. 2 and 4, is provided in the lower check valve 59 to limit the distance to which the lower valve ball 62 is free to move away from the lower valve seat 60 to a small distance which is, for example, less than half the radius 65 of the lower valve ball 62 and which preferably is about 1/16 inch in a pour spout 10 whose spout body 12 is $\frac{3}{4}$ inch in diameter. The retainer 64 includes a cylindrical bore 66 and has a plurality of notches 68, similar to the notches 56, which intersect the bore 66 to provide a path for flow of liquid around the surface of the lower valve ball 62 when it is displaced away from the lower valve seat 60 and held by the retainer 64 at its most distant location from the lower valve seat 60.

As may be seen in FIG. 4, a plurality of vertical guide posts 72 are located within the lower check valve 59 to keep the valve ball 62 located centrally with respect to the valve seat 60, yet permit liquid to flow around the valve ball 62 within the space provided between the guide posts 72.

In the lower portion 42 of the air inlet tube 40 is a third, or air inlet conduit check valve 74 including an annular air inlet check valve seat 76 having a spherical surface, and a movable air inlet check valve closure body such as a check valve ball 78 which fits sealingly against the air inlet check valve seat 76 and is movable upwardly away from the air inlet check valve seat 76 to permit air to flow through the air inlet conduit 36 from the upper end 38 toward the interior of a bottle in whose neck 18 the nonrefillable pour spout 10 is fitted. A retainer 80, similar to the retainers 52 and 64, permits the air inlet check valve ball 78 to move only a small distance, for example 1/32 inch, in the case of a valve ball 78 $\frac{1}{8}$ inch in diameter, in an air inlet conduit having an inside diameter of 1/16 inch, away from its seat 76 in opening the check valve 74. Like the retainer 64, the retainer 80 includes a cylindrical bore 82, and a plurality of notches 84 intersect the bore 82 at a sloping angle to permit the flow of air around the check valve ball 78 when it is located in contact with the retainer 80. A plurality of guide posts 86 hold the check valve ball 78 in a central location relative to the check valve seat 76. The air inlet check valve 74 is located centrally beneath the lower valve seat 60 so that when liquid is poured with the pour spout 10 in an attitude tilted above horizontal the valve ball 78 will be floated away from the seat 76 to admit air as liquid opens the upper check valve 46 and lower check valve 59 in the liquid pouring duct.

Figure 5:
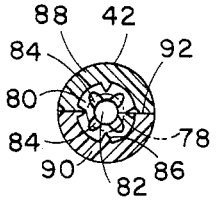
FIG. 5 is a sectional view of the air inlet tube portion of the pour spout shown in FIG. 1, taken along the line 5—5 of FIG. 2.

The spout body 12 is preferably molded of opaque plastic, preferably in two segments 88 and 90 defined by a generally planar mating surface 92, as indicated in FIGS. 3, 4 and 5. (While FIG. 2 is a sectional view of the pour spout 10, it also is equivalent to a view of the segment 88, and the segment 90, since it is symmetrically opposite, is not shown separately.) The check valve balls 50, 62, and 78 may be placed in the appropriate check valve portions in one of the segments 88 or 90, after which the other segment is placed alongside it in proper alignment, which may be assured by providing mating projections and recesses 96 located on the mating surfaces of the segments 88 and 90. Additionally, the segments 88 and 90 may be molded together, joined for example, by thin strips of plastic material (not shown) which will hold the segments properly aligned with one another until they are mated, making it easier to insert the valve balls 50, 62, and 78 mechanically. Thereafter, the segments 88 and 90 may be mated to one another and fused together by a suitable adhesive or by ultrasonic welding, using techniques which do not form a part of this invention, before insertion into the neck 18 of a bottle.

The non-refillable pour spout 10 is inserted into the neck 18 of a bottle by being pressed thereinto until the top 14 of the spout body 12 is aligned with the top edge 28 of the neck 18 of the bottle, leaving the columns 35 and the flange 34 exposed above the top edge 28 to provide a path for air to enter into the upper end 38 of the air inlet conduit 36. When the bottle is tipped to pour fluid from its interior, the force of liquid against the underside of the lower valve ball 62 will push it away from the lower valve seat 60, and the liquid will be able to flow into the liquid pouring duct 30, proceeding around the lower valve ball 62, through the notches 68 and the bore 66, into the upper check valve 46, where the liquid will also displace the upper valve ball 50 from the upper valve seat 48. The liquid will then be able to flow around the upper valve ball 50 between the guide posts 58, through the notches 56 and bore 54 into the interior of the discharge tube 32. The liquid can then exit from the non-refillable pour spout 10 through the outer end 33 of the discharge tube 32 and will then be able to run radially to the edge of the flange 34 without flowing into the upper end 38 of the air inlet conduit 36.

At the same time, the air inlet check valve ball 78 will be moved away from its seat 76 and air will enter the interior of the bottle through the air inlet conduit 36. As long as the lower portion 42 of the air inlet tube 40 is submerged with the bottle upright or tilted above the horizontal, the valve ball 78 will float free of the seat 76. If the bottle is tipped below the horizontal, the flow of liquid outward through the liquid pouring duct 30 will be sufficient to reduce the pressure within the bottle to the point where air will attempt to replace the liquid by flowing inward through the air inlet conduit 36 and the air inlet check valve 74, which will then be located in a zone of fluid pressure lower than that at the upper check valve 46. It is important that the sizes of the liquid pouring duct 30 and the air inlet conduit 36, and the distances to which the valve balls 50, 62 and 78 are free to move from their respective seats, be chosen keeping in mind the characteristics of the liquid to be poured so that liquid can flow through the liquid pouring duct 30 and ample air can enter through the air entry conduit 36 to avoid gurgling caused by air attempting to enter the bottle through the liquid pouring duct 30, yet prevent outward flow of liquid through the air inlet conduit 36. For this purpose, the liquid pouring duct 32 should define a flow path whose cross-sectional area is greater than that of the air inlet conduit. For pouring liquids having a viscosity similar to water, an air inlet conduit 36 whose diameter is 1/16 inch is satisfactory in combination with a liquid pouring duct 30 whose inside diamete is $\frac{1}{4}$ inch.

However, if one should attempt to introduce liquid into the bottle through the air inlet conduit 36, the weight of liquid above the air inlet check valve ball 78 will hold the ball 78 against its seat 76, preventing entry of liquid into the bottle through that path. Similarly, if one should attempt to pour liquid into the bottle through the liquid pouring duct 30 with the non-refillable pour spout 10 in an upright or upwardly-inclinded attitude, the weight of the lower valve ball 62 will cause it to be seated against the lower valve seat 60, preventing passage of the liquid into the interior of the bottle in that direction.

If it is attempted to force liquid into the interior of the bottle equipped with the non-refillable spout 10 with the bottle at an attitude in which the upper end 33 of the discharge tube 32 is inclined below the horizontal, the upper check valve ball 50 will be floated into contact with its seat 48, again preventing entry of the liquid into the interior of the bottle. Similarly, attempting to direct liquid into the interior of the bottle through the air inlet conduit 36 with the pour spout 10 in such an attitude will result in the check valve ball 78 floating into contact against its seat 76, also preventing entry of the liquid into the interior of the bottle.

The flange or canopy 34, which extends horizontally above the upper end 38 of the air inlet conduit 36, prevents use of a small tube (such as a hypodermic needle) for forcing fluid in through the air inlet conduit 36. The baffles 44 and 45 and the small amounts of clearance and room for movement of the upper and lower valve balls 50 and 62 make it difficult to insert a tool into the interior of the pour spout 10 in such a manner as to hold the valve balls 50 and 62 away from the their respective seats 48 and 60 to permit refilling of the bottle in which the pour spout 10 is installed, even if the baffles 44 and 45 can be negotiated.

Because of the construction of the collars 20 removal of the nonrefillable spout 10 from the neck 18 of the bottle would be extremely difficult to accomplish without causing easily noticable damage to the non-refillable pour spout 10, such as separation of the two segments, making it impractical to remove and replace the spout 10.

Figure 6:
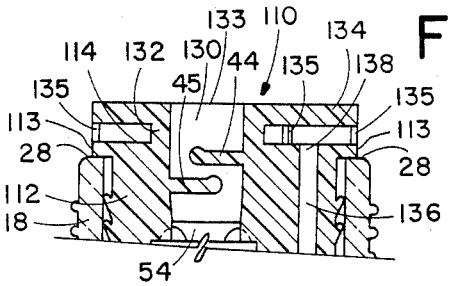
FIG. 6 is a fragmentary view similar to a portion of FIG. 2 and showing another embodiment of the invention.

Referring now to FIG. 6, a pour spout 110, similar to the pour spout 10 except as detailed herebelow, is shown only partially. A spout body 112 includes a radially extending rim 113 which is of great enough diameter to rest upon the top edge 28 of the neck 18 of the bottle. A flange or canopy 134 extends from the top end 133 of the liquid pouring duct 130 and is aligned with the rim 113. Columns 135 extend vertically between the top end 114 and the flange or canopy 134. The flange or canopy 134 then protects the upper end 138 of the air inlet conduit 136 of the pour spout 110. This different embodiment 110 of the upper end of the non-refillable pour spout of the invention permits an ordinary screw-on bottle cap to be used to seal the bottle for shipment or storage without a risk of forcing the non-refillable pour spout 110 too far into the neck 18 and thereby excluding air from the air inlet conduit 136.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A non-refillable pour spout, for use in the neck of a bottle for permitting liquid to be poured through said spout from within said bottle but resisting replenishment of the liquid in said bottle, comprising:

(a) a generally cylindrical spout body member having a top and bottom and adapted to fit sealingly within the neck of a bottle;

(b) a liquid pouring duct extending through said spout body member and including discharge tube means for defining a liquid discharge opening adjacent the top of said spout body member;

(c) a first check valve located in said liquid pouring duct in said spout body member, including a first valve seat and a movable first valve closure body held within said spout body upwardly adjacent said first valve seat, said first check valve communicating with said discharge tube means;

(d) a second check valve located in said liquid pouring duct in said spout body member, including a second valve seat and a movable second valve closure body held within said spout body upwardly adjacent said second valve seat, said second check valve being located beneath said first check valve and communicating with said first check valve;

(e) an air inlet tube attached to said spout body member and having a lower end extending downwardly therebeneath;

(f) an air inlet conduit having an open upper end located in said top of said spout body member, said air inlet conduit extending through said spout body member and said air inlet tube, from said top of said spout body member to said lower end of said air inlet tube; and (g) a third check valve located in said air inlet conduit, including a valve seat and a movable third valve closure body held within said air inlet conduit and located upwardly adjacent said third valve seat.

2. The pour spout of claim 1 wherein one of said first and second movable valve closure bodies is less dense and the other of said first and second valve bodies is more dense and said third movable valve body is less dense than a liquid to be contained in a bottle equipped with said pour spout.

3. The pour spout of claim 1 wherein the lower end of said air inlet tube is located centrally beneath said second check valve when said spout body member is fitted in a bottle.

4. The pour spout of claim 1 wherein said liquid discharge opening, said first check valve, and said second check valve define a liquid flow path area, and said air inlet conduit has an air path area of smaller size.

5. The pour spout of claim 1 wherein each of said first and second movable valve closure bodies is spherical and is movable away from its respective valve seat a maximum distance smaller than its own radius.

6. The pour spout of claim 5 wherein said third movable valve closure body is spherical and is movable away from said third valve seat a maximum distance smaller than its own radius.

7. The pour spout of claim 1, including respective valve closure body retainer means for holding each of said movable valve closure bodies within a predetermined distance from its respective valve seat, each said valve body retainer means defining a plurality of flow notches therein through which liquid can flow while said valve closure bodies are retained by said retainer means.

8. The pour spout of claim 1 including a plurality of radially extending collars disposed circumferentially about said spout body member and spaced apart from one another between said top and said bottom for sealingly retaining said pour spout in the neck of a bottle.

9. The pour spout of claim 1, said discharge tube means of said liquid pouring duct extending beyond said top of said spout body member, said pour spout further including a flange extending radially outward about said discharge tube means and located spaced apart from and above said upper end of said air inlet conduit as a canopy protecting said upper end of said air inlet conduit.

10. The pour spout of claim 9, including a plurality of support columns extending between said flange and said top of said spout body member.

11. The pour spout of claim 1 wherein said body includes a plurality of mating segments, each including structure defining a portion of each of said first and second check valves.

12. The pour spout of claim 11 wherein said air inlet tube is defined by at least two of said plurality of segments.

13. The pour spout of claim 11 wherein at least one of said plurality of segments is defined partially by a substantially planar mating surface.

14. The pour spout of claim 13 wherein each of said plurality of segments includes alignment member means for mating with corresponding structure on another of said plurality of segments to hold said mating segments aligned with one another.

15. The pour spout of claim 1 wherein each of said first and second valves includes a plurality of guides extending parallel with one another and spaced apart from one another about the respective valve seat so as to hold the respective movable valve closure body centrally located with respect to the respective valve seat.

16. A refill-resistant pour spout for use in the neck of a bottle for permitting liquid to proceed outwardly through said pour spout from within said bottle but resisting replenishment of the liquid in said bottle, comprising:

(a) a generally cylindrical spout body member having a top and a bottom and adapted to fit sealingly within the neck of a bottle;

(b) means connected with said spout body member for sealingly holding said spout body member within the neck of a bottle;

(c) a liquid pouring duct defined through said spout body member from said bottom to said top;

(d) at least two ball check valves located in said liquid exit conduit, each of said check valves completely closing said liquid pouring duct when in a closed condition;

(e) an air inlet conduit extending through said spout body member from said top to said bottom thereof and including an open upper end located in said top of said spout body member and a portion defined by an air inlet tube extending below said spout body member;

(f) a ball check valve located within said air inlet tube and capable of closing said air inlet conduit against entry of fluid into said bottle therethrough;

(g) a liquid discharge tube defining an uppermost portion of said liquid pouring duct and extending above said top of said spout body member; and (h) protective canopy means extending radially from said liquid exit conduit and above said open upper end of said air inlet conduit.

* * * * *